United States Patent [19]

Cone et al.

[11] 4,014,028

[45] Mar. 22, 1977

[54] BACKFIRE BIFILAR HELICAL ANTENNA

[75] Inventors: John A. Cone, Cypress; Robert A. Archer, Torrance; Edward R. Pacheco, Fountain Valley; Creath E. Peyton, Torrance, all of Calif.

[73] Assignee: TRW Inc., Redondo Beach, Calif.

[22] Filed: Aug. 11, 1975

[21] Appl. No.: 603,429

[52] U.S. Cl. ..... 343/895; 343/840

[51] Int. Cl.[2] ..... H01Q 1/36

[58] Field of Search ..... 343/895, 840

[56] References Cited

UNITED STATES PATENTS

| | | | |
|---|---|---|---|
| 3,019,438 | 1/1962 | Pan | 343/895 |
| 3,617,890 | 11/1971 | Kurauchi | 343/895 |

FOREIGN PATENTS OR APPLICATIONS

| | | | |
|---|---|---|---|
| 741,897 | 12/1955 | United Kingdom | 343/895 |

*Primary Examiner*—Alfred E. Smith
*Assistant Examiner*—David K. Moore
*Attorney, Agent, or Firm*—Edwin A. Oser; Jerry A. Dinardo

[57] ABSTRACT

A bifilar helical antenna which will radiate or receive in the backfire mode. The antenna consists of two interlaced helixes fed at the tip. Each helix is fed by a transmission line with energy of equal amplitude but 180° out of phase. Optionally the helixes may be connected to a ground plane at the far end for mechanical stability. For the same reason an insulating right cylinder may be used to support the helixes. The two helixes have such a diameter and such a pitch or pitch distance that the currents flowing from their terminals to the far end are out of phase while the currents flowing in the reverse direction are in phase to provide a fast pseudo wave structure.

5 Claims, 2 Drawing Figures

BACKFIRE BIFILAR HELICAL ANTENNA

BACKGROUND OF THE INVENTION

This invention relates generally to antennas for radiating or receiving a circularly polarized wave and particularly relates to an antenna of this type consisting of a bifilar helix operating in the backfire mode.

For some applications it is desirable to provide an antenna for radiating a circularly polarized wave. Among circularly polarized antennas is a bifilar helix which has been used in the past. However, the conventional bifilar helix radiates in the forward direction. In other words, such an antenna may be considered a slow wave structure where the currents are in phase at each turn of the two helixes of the antenna. Hence the antenna must be fed at one end and the wave radiates in the opposite direction of the feed. If the antenna is to be used with a reflector such as a parabolic reflector it creates a mechanical problem for supporting the antenna. At the same time it is desirable to provide an antenna of high efficiency which completely illuminates the reflector without any spill-over of the radiation.

It is accordingly an object of the present invention to provide an antenna for radiating or receiving circularly polarized waves which is characterized by a high efficiency and low aperture blockage.

Another object of the present invention is to provide a bifilar helix which will provide good illumination of the reflector with low spill-over and which, due to its small diameter, provides a minimum of obstruction to the reflected wave.

SUMMARY OF THE INVENTION

A backfire antenna in accordance with the present invention will either radiate or receive a circularly polarized wave and is capable of operation over a wide frequency range. The antenna comprises a first and a second helix, each having a constant diameter and being interlaced and wound in the same direction. Each helix has an input terminal. Means such as a transmission line is connected to each of the two terminals for the transfer of high frequency currents of substantially equal magnitudes substantially 180° out of phase.

To this end the helixes have such a diameter and such a pitch that the high frequency currents on adjacent turns are out of phase and cancel each other for currents moving from the terminals toward the free ends of the helixes. On the other hand, currents moving in the opposite direction are in phase, thereby to provide the backfire mode of operation.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENT

Figure 1:
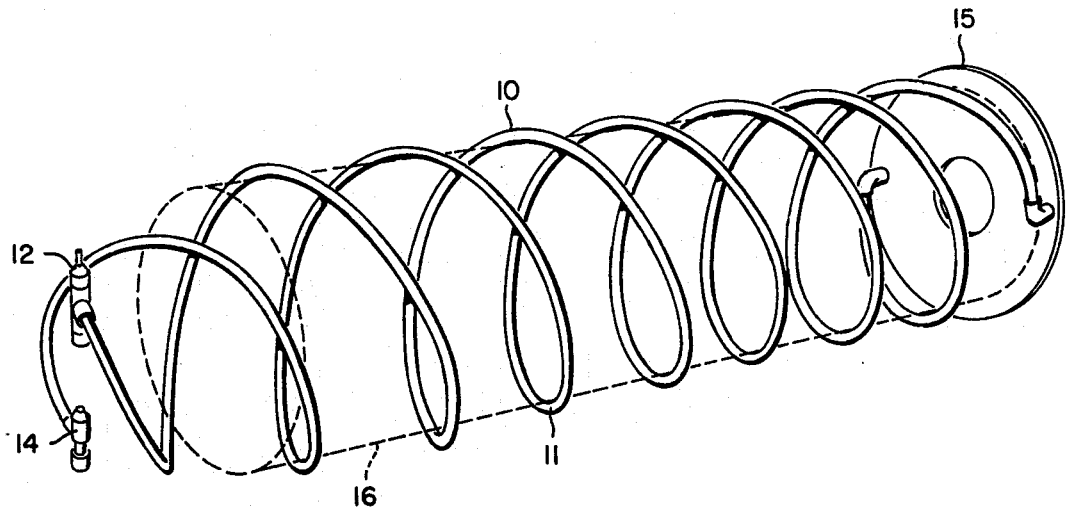
FIG. 1 is a view in perspective of a bifilar helix in accordance with the present invention.

Referring now to the drawing and particularly to FIG. 1, there is illustrated a bifilar antenna embodying the present invention. The bifilar antenna includes a first helix 10 and a second helix 11 which are interlaced and wound in the same direction. The two helixes 10 and 11 have a constant diameter, that is they may be wound on a right cylinder. Each of the helixes 10 and 11 has a terminal 12 and 14 respectively from which the antennas may be fed or from which received energy may be obtained.

The helixes 10 and 11 may consist of wire or of suitable tubing to provide mechanical rigidity. The free ends of the helixes 10 and 11 may be connected to each other by a ground plate 15 which, however, is optional and may be omitted. However, the ground plate 15 will provide additional mechanical rigidity to the structure. It is also feasible to provide a central cylinder 16 shown in dotted lines for the purpose of providing additional mechanical support. This cylinder or core 16 should consist of an insulating material preferably of lightweight such, for example, as styrofoam.

Figure 2:
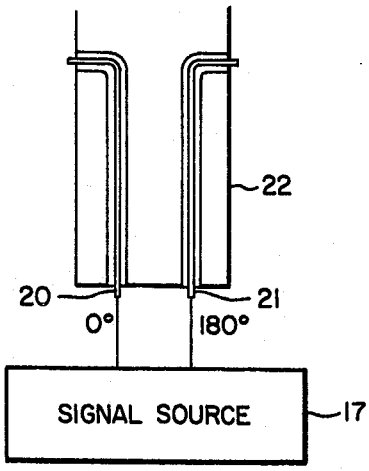
FIG. 2 is a cross-sectional view of a pair of transmission lines and a signal source for feeding the two helixes of the antenna.

As shown particularly in FIG. 2, for radiating purposes the antenna may be fed by a signal source 17 to which are connected two transmission lines 20 and 21 which as shown are fed 180° out of phase with respect to each other. The transmission lines may consist of a balun, for example, which may be a double quarter-wavelength slot balun extending through suitable openings in a cylinder 22 by means of which the antenna may be supported. Thus, to summarize, the two helixes 10 and 11 are fed by high frequency energy 180° out of phase but with equal amplitude.

In order for the antenna to operate as a backfire antenna or a fast pseudo wave structure it is basically necessary that the currents or voltages flowing in the two helixes 10 and 11 from their respective terminals 12, 14 are out of phase with respect to each other. This means that the energy cancels each other and no radiation in the forward direction is possible. On the other hand, in order for the antenna to fire in a backward direction, that is from the ground plate 15 toward the terminals 12, 14 it is necessary that the currents in that direction be in phase at the turns of the helixes.

This can be controlled by a proper selection of the diameter of the two helixes and of the pitch angle or the pitch distance which corresponds to a complete turn of each helix. Thus, the diameter of the antenna may range between 0.18 and 0.4 $\lambda$, where $\lambda$ is the wavelength. Preferably, the diameter is approximately ¼ of a wavelength of less. On the other hand, the circumference between adjacent turns or the pitch distance which controls the pitch angle may be between ¾ and 1⅓ of a wavelength. The operational wavelength or frequency may vary between wide ranges and may be in the megacycle or gigacycle range.

It has been found that the antenna is appreciably insensitive to the number of turns beyond a minimum number. Thus, the number of turns may vary between 2 and 8 but if more turns are added they will not contribute to the antenna performance. This is the reason why a ground plate such as 15 may be connected between the two helixes at the outer ends. This will cause substantially no degradation in performance.

It will be understood that the antenna of the invention may be used with a parabolic reflector and such an antenna system has been found to have a peak efficiency of 70% which compares with a typical antenna efficiency of 50%.

It should be notes that a left-hand helix produces a right-hand polarization and vice versa.

It will, of course, be understood that like any antenna the antenna of the invention may not only be used as a radiating antenna, but may be used with equal ease as a receiving antenna.

There has thus been disclosed a bifilar helix arranged to provide a backfire radiation. The high frequency energy is circularly polarized. It has the advantage that it will provide good illumination of a parabolic reflector substantially without spill-over of energy. The efficiency of the antenna system including the bifilar helix and a parabolic reflector substantially exceeds the efficiency of a typical antenna. Due to its small diameter the antenna provides low aperture blockage and as a result most of the energy radiated can be reflected back in the desired direction.

What is claimed is:

1. A backfire antenna for radiating or receiving a circularly polarized wave over a predetermined frequency range, said antenna comprising:

a. a first helix having a constant diameter;

b. a second helix having a constant diameter and being wound in the same direction of that of said first helix, each of said helixes having an input terminal, and said helixes being coaxial; and c. means connected to the input terminal of said first helix and to the input terminal of said second helix for simultaneous transfer of high frequency current to each helix, said currents being of substantially equal magnitudes and substantially 180° out of phase with respect to each other, said helixes having such a diameter and such a pitch that the high frequency currents on adjacent turns of said helixes are out of phase and cancel each other for currents moving from said terminals outwardly, while currents moving towards said terminals at opposite points of said helix are in phase to provide a backfire antenna, whereby a circularly polarized wave is received or radiated backward from said terminals, the circularly polarized wave having a direction of polarization opposite that of the direction of winding of said helixes.

2. An antenna as defined in claim 1 wherein each of said helixes has between two and eight turns.

3. An antenna as defined in claim 1 wherein the diameter of said helixes is between approximately 0.18 and approximately 0.4 of the wavelength.

4. An antenna as defined in claim 3 wherein the diameter of said helixes is no more than 1/4 of the wavelength.

5. An antenna as defined in claim 1 wherein each of said helixes at its end opposite is terminal is grounded by a ground plane.

* * * * *